US006622316B1

(12) United States Patent
Brown

(10) Patent No.: US 6,622,316 B1
(45) Date of Patent: Sep. 23, 2003

(54) DRIPLESS PLUNGER

(76) Inventor: Owen Brown, 102 Highland Ave., Montclair, NJ (US) 07042

( * ) Notice: Subject to any disclaimer, the term of this patent is extended or adjusted under 35 U.S.C. 154(b) by 0 days.

(21) Appl. No.: 10/201,086

(22) Filed: Jul. 22, 2002

(51) Int. Cl.[7] ..... E03D 11/00
(52) U.S. Cl. ..... 4/255.11; 206/349
(58) Field of Search ..... 4/255.01, 255.11; 206/349

(56) References Cited

U.S. PATENT DOCUMENTS

| | | | | | |
|---|---|---|---|---|---|
| 1,193,476 | A | | 8/1916 | Block | 4/255.11 |
| 5,305,882 | A | * | 4/1994 | Kaplan et al. | 206/349 |
| 5,456,356 | A | * | 10/1995 | Kurzawa | 206/349 |
| 5,927,492 | A | * | 7/1999 | Moore | 206/349 |
| 5,974,596 | A | | 11/1999 | Strzok | 4/255.11 |
| 6,035,456 | A | * | 3/2000 | Taylor | 4/255.11 |
| 6,038,709 | A | * | 3/2000 | Kent | 4/255.11 X |
| 6,145,135 | A | | 11/2000 | Pool et al. | 4/255.09 |
| 6,192,525 | B1 | | 2/2001 | Tash | 4/255.11 |

* cited by examiner

*Primary Examiner*—Robert M. Fetsuga
(74) *Attorney, Agent, or Firm*—Cohen, Pontani, Lieberman & Pavane

(57) ABSTRACT

A dripless plunger includes a head connected to a shaft and a cover movable under user control of an actuator on the shaft from a closed position in which the cover overlies the head to prevent drippage from the head after use of the plunger to clear a clogged drain, and an open position in which the cover is moved to a position remote from the head to permit the head to be placed sealingly about the drain and deformed for forcing water through the drain to unclog the same.

25 Claims, 8 Drawing Sheets

DRIPLESS PLUNGER

BACKGROUND OF THE INVENTION

1. Field of the Invention

The present invention relates to a plumbing device for clearing obstructions from toilets and drain pipes and the like which includes an integrated cover to prevent drippage of liquids from the plunger after use.

2. Description of the Related Art

Conventional hand-operated plungers include a resiliently deformable cup or head attached to a handle. During use, the cup is positioned over a clogged drain to form a seal thereabout, and the handle is then depressed causing the cup to collapse and apply pressure to the obstruction in the drain. The cup portion of the plunger has been designed in many different configurations for various applications and to increase the applied pressure. For example, U.S. Pat. No. 1,193,476 (Block) discloses a plunger having a basic cup-shaped design with a reinforced rim; U.S. Pat. No. 5,974,596 (Strzok) discloses a plunger device having an inner cavity and an outer cavity for applying pressure to the obstruction; U.S. Pat. No. 6,145,135 (Pool, et al.) discloses a plunger having a helical shaped side wall, i.e., a spiral pleat, for imparting a vortex motion to water drawn through and expelled through the nozzle; and U.S. Pat. No. 6,192,525 (Tash) discloses a plunger having an end adapted for drains of various sizes and shapes and that also includes pleated bellows which compress together during use of the plunger.

A problem with all of the above-mentioned plunger designs is that, as the plunger is removed from the location of its use to a storage location, liquid remaining on the plunger will often drip onto the floors, carpets, or underlying surfaces during transport. One solution is to hold a protective device, i.e., a cloth or catch basin, beneath the plunger during transport. However, this solution requires that a separate part to be held during transport and is messy and inconvenient.

SUMMARY OF THE INVENTION

It is an object of the present invention to provide a plunger that includes an integral cover that prevents drippage and thereby avoids inadvertent soiling of floors, carpets, and underlying surfaces as the plunger is removed from the location of its use to its storage location.

In accordance with the invention, a plunger includes a deformable head capable of operatively of forcing water through a drain pipe, and a handle connected to the head. In addition, the inventive plunger includes an integral cover movable from a closed position to an open position. In the closed position, the cover encloses the head and prevents liquid from dripping from the head onto an underlying surface. The cover is movable to its open position in which the head is exposed and uncovered to permit the intended drain-clearing use of the head.

In a first embodiment, the cover comprises a one piece cover element having sections divided by slits. The sections flex outwardly as the cover passes over the head during movement between the closed position and the open position.

In a second embodiment, the cover comprises a plurality of discrete cover sections, each pivotally connected to a shaft that is in turn connected to the head. The handle is movable along a longitudinal axis of the shaft. Each discrete cover section is also connected to the handle via links so that, as the handle moves along the shaft in the direction away from the head, the discrete cover sections pivot toward the open position.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE CURRENTLY PREFERRED EMBODIMENTS

Figure 1:
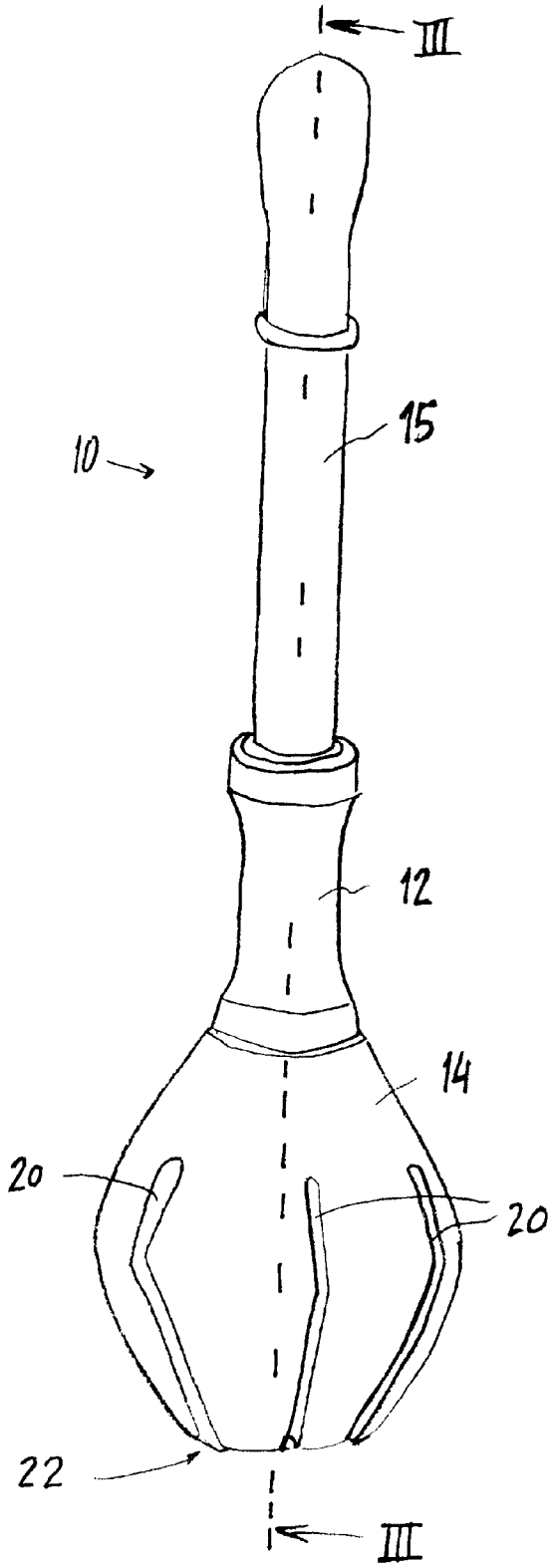
FIG. 1 is a side view of a plunger according to the present invention in the closed position.
Figure 2:
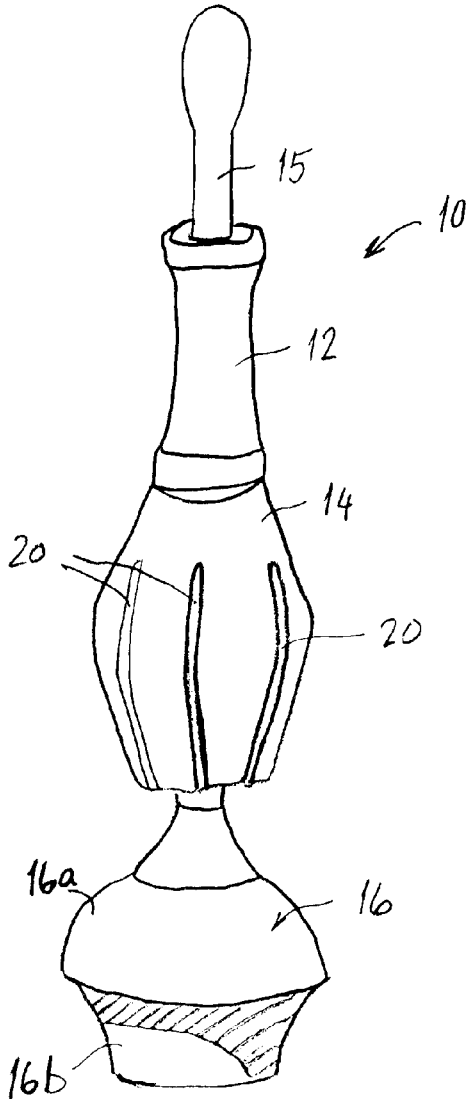
FIG. 2 is a side view of the plunger of FIG. 1 in the open position.
Figure 3:
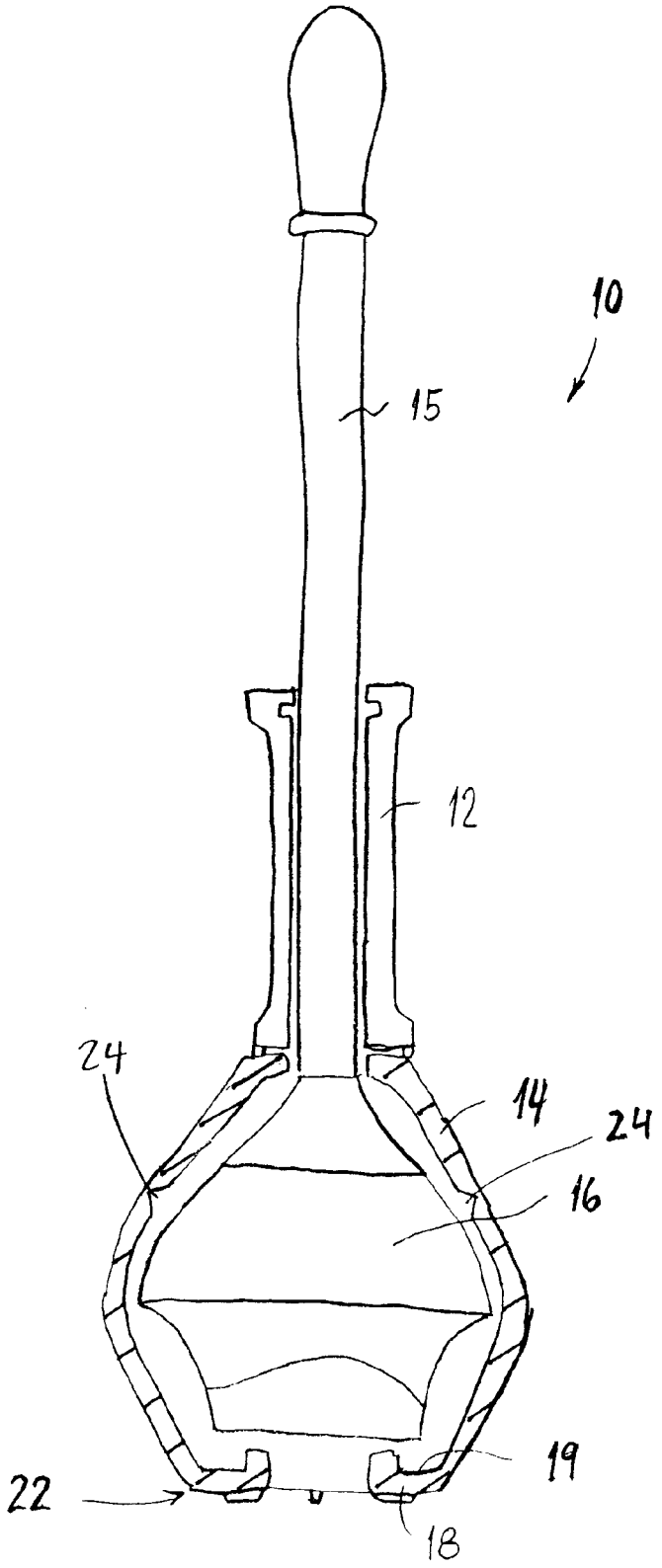
FIG. 3 is a sectional view of the plunger of FIG. 1 taken along the line III—III.
Figure 4:
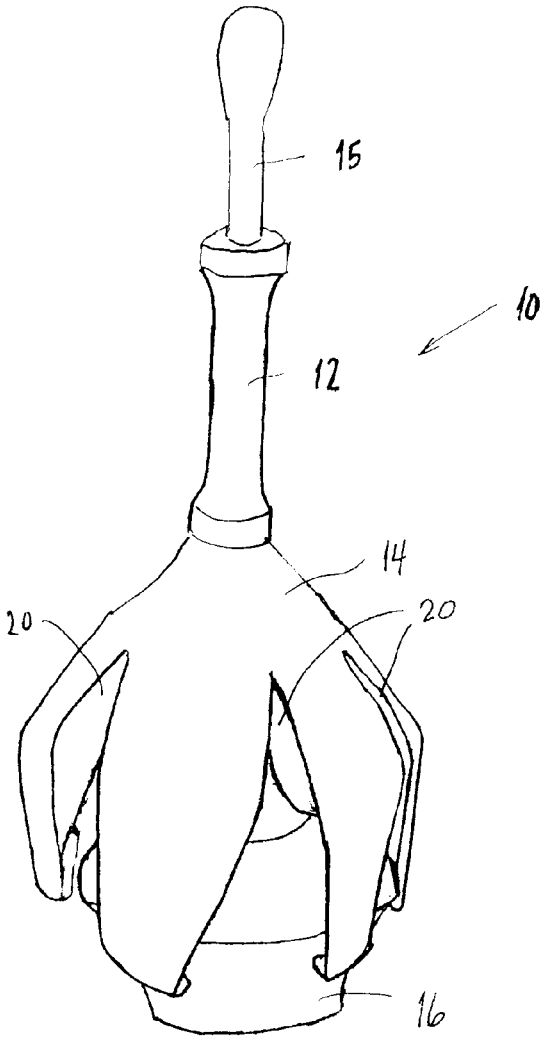
FIG. 4 is a perspective view of the plunger of FIG. 1 showing the cover in an intermediate position between the closed and open positions.

A plunger 10 constructed in accordance with a first embodiment of the present invention is shown in FIGS. 1–4. The plunger 10 is seen in its closed position in FIG. 1 and in its open position in FIG. 2, and includes a shaft 15 having one end connected to a head 16. The head 16 and shaft 15 are used in a conventional manner to force liquid through a drain pipe to remove obstructions by forcing them through the pipe under the pressure created by deformation of the head. Thus, the head 16 is positioned to create a seal around the drain to be unclogged, and the shaft 15 is advanced toward the head 16 to collapse the head and create a surge of pressure in the drain pipe to be unclogged. Accordingly, the head 16 must be formed of a material, such as rubber, that is flexible and that is self-restoring to its original shape when the advancing force on the shaft 15 is removed or discontinued. The shaft, on the other hand, must be formed of a rigid material such, for example, as metal, wood, fiberglass, or another similarly unyielding material. The head 16 is shown in FIGS. 1–4 as having a generally cup-shaped upper part 16*a* connected to an end portion or member 16*b*. Nevertheless, the head 16 may comprise any head design suitable for creating a seal around a clogged pipe and forcing water or liquid through the pipe under pressure to remove an obstruction therein, such by way of illustrative example as, but not limited to, the heads disclosed in U.S. Pat. No. 1,193,476 (Block), U.S. Pat. No. 5,974,596 (Strzok), U.S. Pat. No. 6,145,135 (Pool, et al.), or U.S. Pat. No. 6,192,525 (Tash).

The plunger 10 also includes a cover 14 and a pull handle 12 connected to cover 14. Pull handle 12 is movable along shaft 15 from a first position proximate head 16, in which the cover 14 surrounds head 16 (see FIG. 1), to a second position in which cover 14 is displaced to a location remote from head 16 (FIG. 2) so that head 16 is ready for its intended use in clearing a clogged drain. Cover 14 includes a plurality of slits 20 which allow the sections of cover 14 between and defined by slits 20 to flex outward over head 16 as the pull handle 12 is moved from its first position to its second position (see FIG. 4). Accordingly, cover 14 is constructed of a flexible material such as rubber or urethane. Cover 14 may also be molded or otherwise formed to have thinned-out wall sections or grooves 24 to define living hinges (see FIG. 3) that facilitate flexing of the cover sections 14 between slits 20. The pull handle takes the form of a hollow tube, which may, for example, be molded, and comprises a sufficiently rigid material such as polypropylene or styrene so that pull handle 12 may be manipulated to selectively displace cover 14.

When the plunger 10 is to be used to clear a drain, pull handle 12 is displaced from its first position to its second position so that cover 14 is removed from its FIG. 1 position about head 16. After use of the plunger, pull handle 12 is returned to its first position so that cover 14 is again disposed encirclingly over and about head 16. A base region 22 along the bottom of cover 14 defines a flattened area or rim capable of supporting plunger 10 in a free-standing position for storage or otherwise during periods of non-use.

Figure 5:
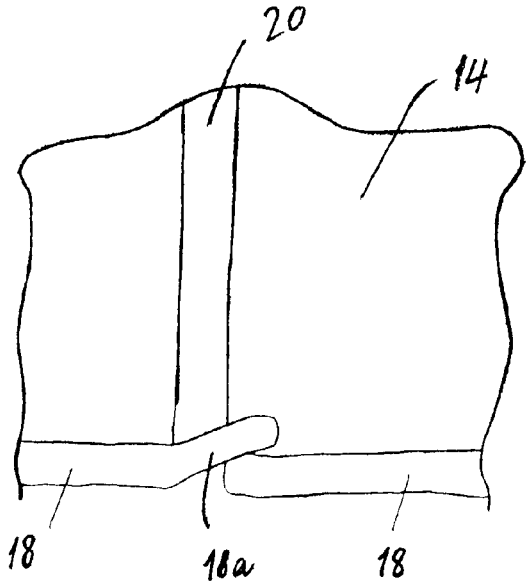
FIG. 5 is a partial view of a plunger cover showing a slit in the plunger cover.

The base region of cover 14 also forms a lip 18 that, in the first position of cover 14, is disposed below the lower most extension of head 16. Lip 18 (see FIG. 3) defines a trough or groove 19 configured to retain any liquid that drips from head 16 after use of the plunger, as during transport of the plunger from its place of use to its place of storage. The lip 18 of each section of cover 14 between alignment slits 20 may also carry an optional extension 18*a* (FIG. 5) which projects from that cover to a position partly overlapping the next adjacent cover section to prevent liquid from dripping from the slits 20 that separate adjacent cover sections.

Figure 6:
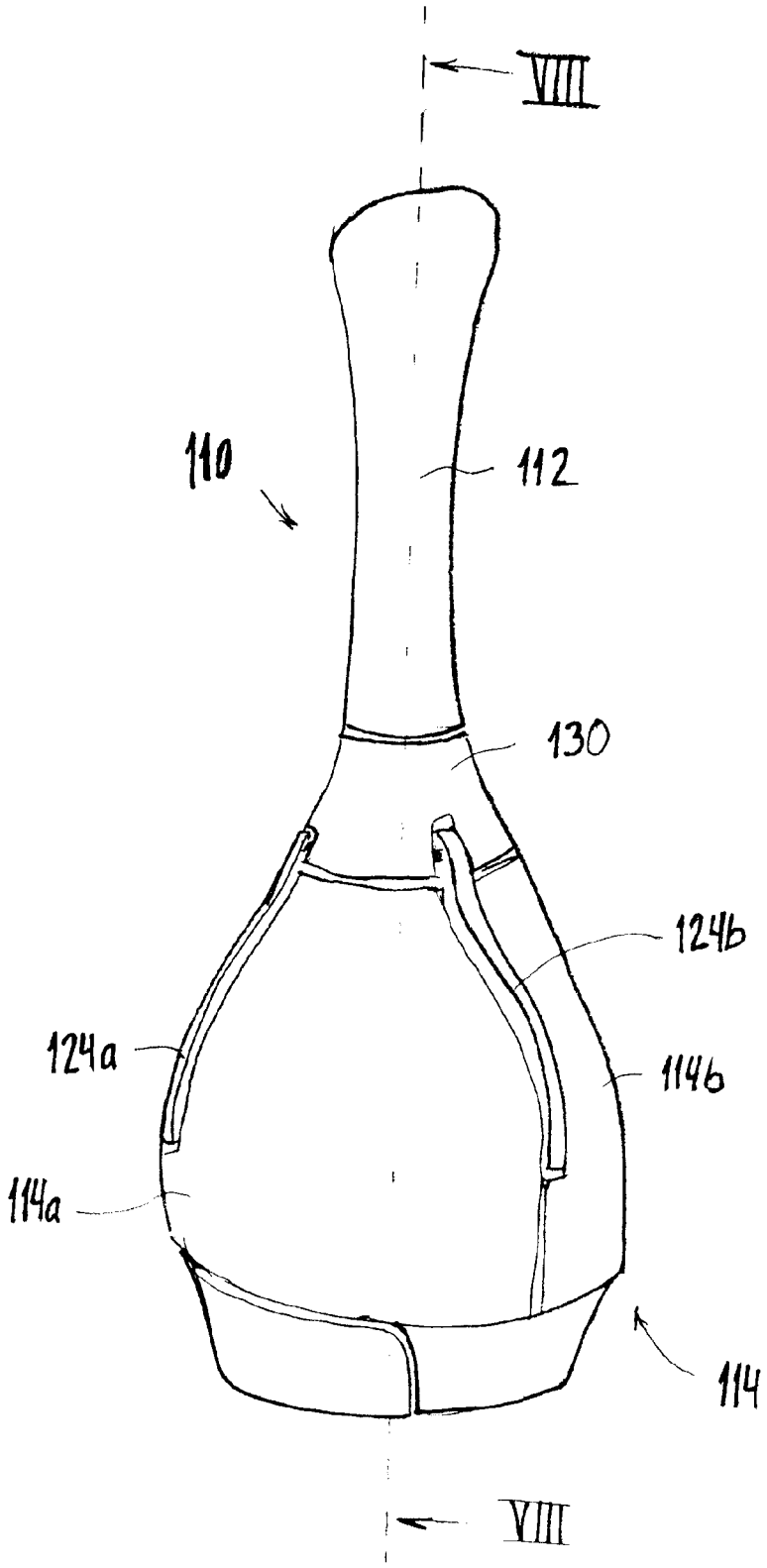
FIG. 6 is a side view of a plunger according to a further embodiment of the present invention in the closed position.
Figure 7:
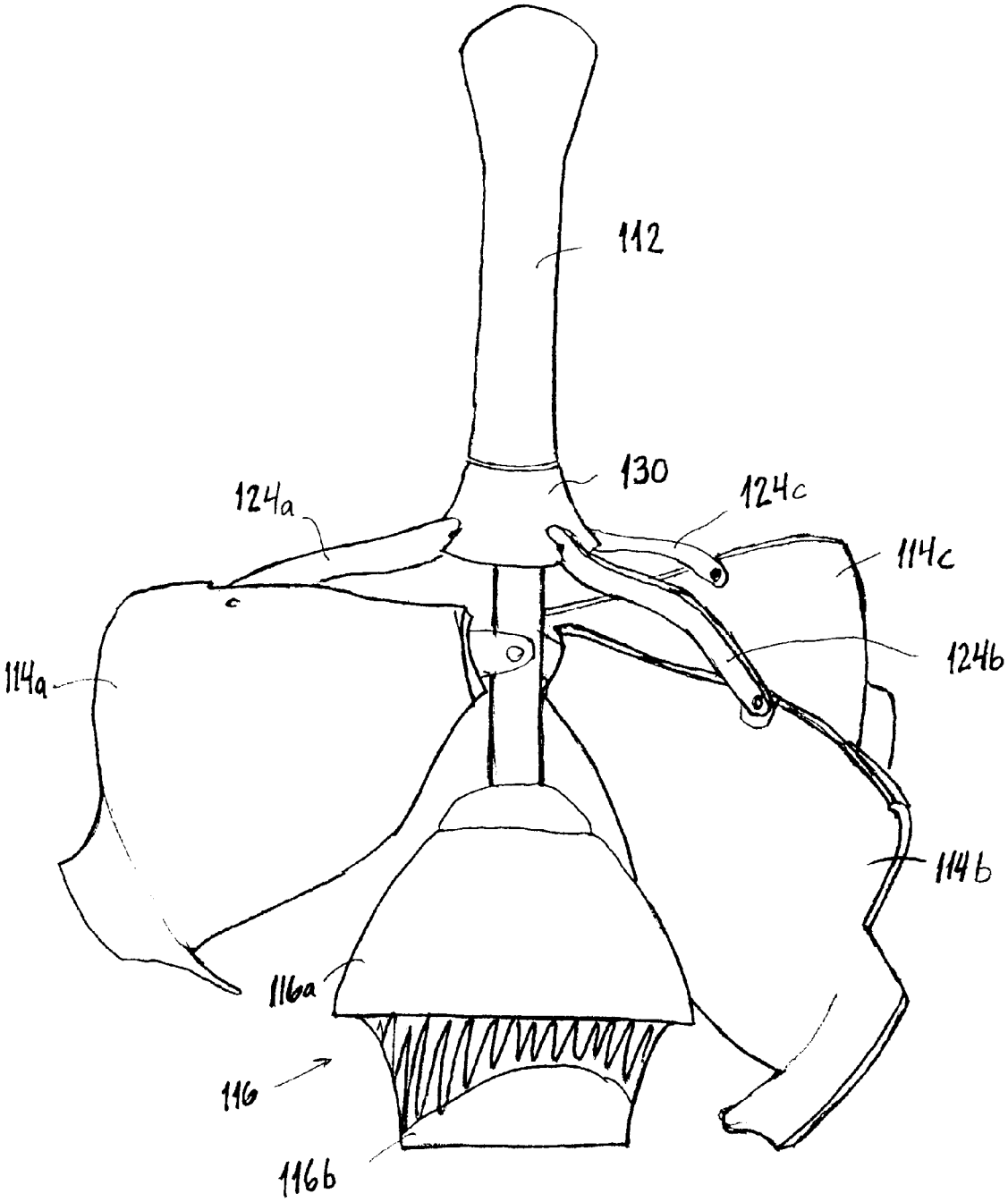
FIG. 7 is a side view of the plunger of FIG. 6 in the open position.
Figure 8:
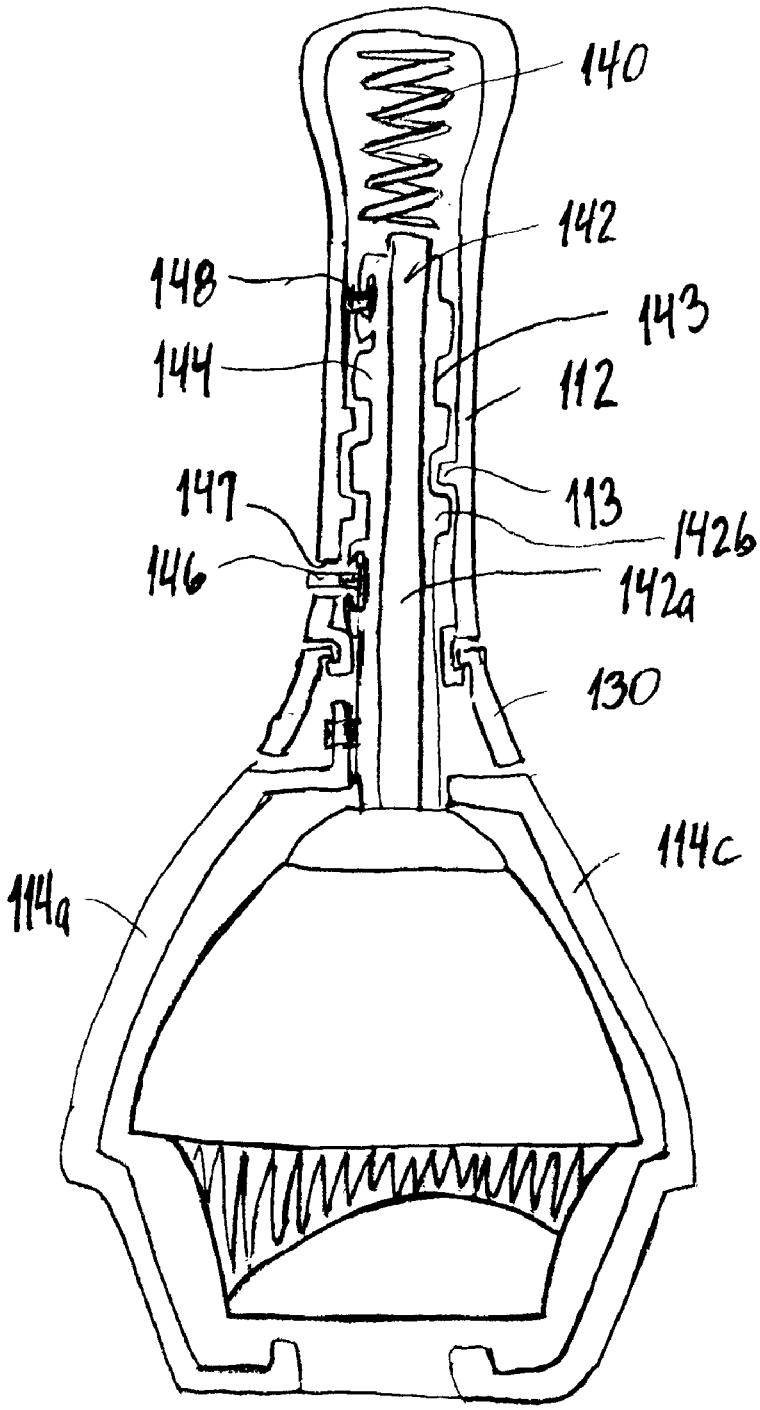
FIG. 8 is a sectional view of the plunger of FIG. 6 taken along the line VIII—VIII.

Another embodiment of a plunger 110 in accordance with the invention is shown in FIGS. 6–8. In the plunger 110 a head 116 is connected to a shaft 142 for use in a substantially conventional manner to operatively force liquid through a clogged or obstructed drain pipe. The head 116 and shaft 142 may be constructed in an manner similar to the head 16 and shaft 15 of the embodiment of FIGS. 1–5.

Plunger 110 also includes a cover 114 and an associated handle 112. Cover 114 is formed in the illustrated implementation of three separate cover sections 114*a*, 114*b*, 114*c* which are pivotally connected to shaft 142. Although the embodiment shown in the FIGS. 6–8 includes three cover sections, the cover 114 may alternatively be formed of two or more than three cover sections. Each cover section is identical so that the plunger cover is easy to manufacture. FIG. 6 depicts a closed position of cover 114 and FIG. 7 an open position of the cover. Referring to FIG. 8, handle 112 is hollow and fits concentrically over shaft 142. Furthermore, the handle has a radially-inward projection 113 that is movable along and within a helical groove 143 defined in the outer surface of shaft 142. As the handle 112 is selectively rotated relative to shaft 142, the shaft is caused to be telescopically displaced into and out of the handle. Each cover section 114*a*, 114*b*, 114*c* is connected via a respective link 124*a*, 124*b*, 124*c* to a ring 130, and the handle 112 is connected to ring 130 so that ring 130 moves with handle 112 along the length of shaft 142. Shaft 142, however, does not rotate with handle 112 as the handle rotates to drive shaft 142 telescopically into and out of the handle. One end of each link 124*a*, 124*b*, 124*c* is pivotally connected to ring 130 and the other end is pivotally connected to a corresponding one of the cover sections 114*a*, 114*b*, 114*c*. Thus, as the handle is rotated and is relatively displaced along shaft 142, ring 130 is carried with handle 130 to thereby upwardly shift the links 124*a*, 124*b*, 124*c* and pivot the cover sections 114*a*, 114*b*, 114*c* to their open position shown in FIG. 7.

An internal spring 140 is arranged between a top of shaft 142 and the blind end of hollow handle 112. The spring 140 is compressed when cover 114 is in its closed position shown in FIGS. 6 and 8 and thereby urges shaft 142 outwardly from the handle. In addition, a pushbutton 146 is located on shaft 142 and extends through a bore 147 (see FIG. 8) defined in the handle in the fully closed position, thereby retaining cover 114 in its fully closed position against the return urgency of spring 140. When pushbutton 146 is manually depressed and thereby released from its engaged extension into bore 147 of handle 112, the handle telescopes outward under the urgency of spring 140 until the cover 114 attains its fully open position, and the plunger may then be used in its conventional manner. To prevent shaft 142 from exiting handle 112, a stop 148 may be defined in groove 143 for interaction with projection 113 of the handle. Stop 148 may also take the form of a user-depressable pushbutton that engages bore 147 when the cover reaches its fully open position.

To close cover 114 after use, handle 112 is twisted relative to ring 130 to draw shaft 142 into handle 112 against the urgency of spring 140 until the cover attains its fully closed position. If stop 148 is implemented as a pushbutton, it must first be depressed in order to commence the twisting movement of handle 112.

Figure 9:
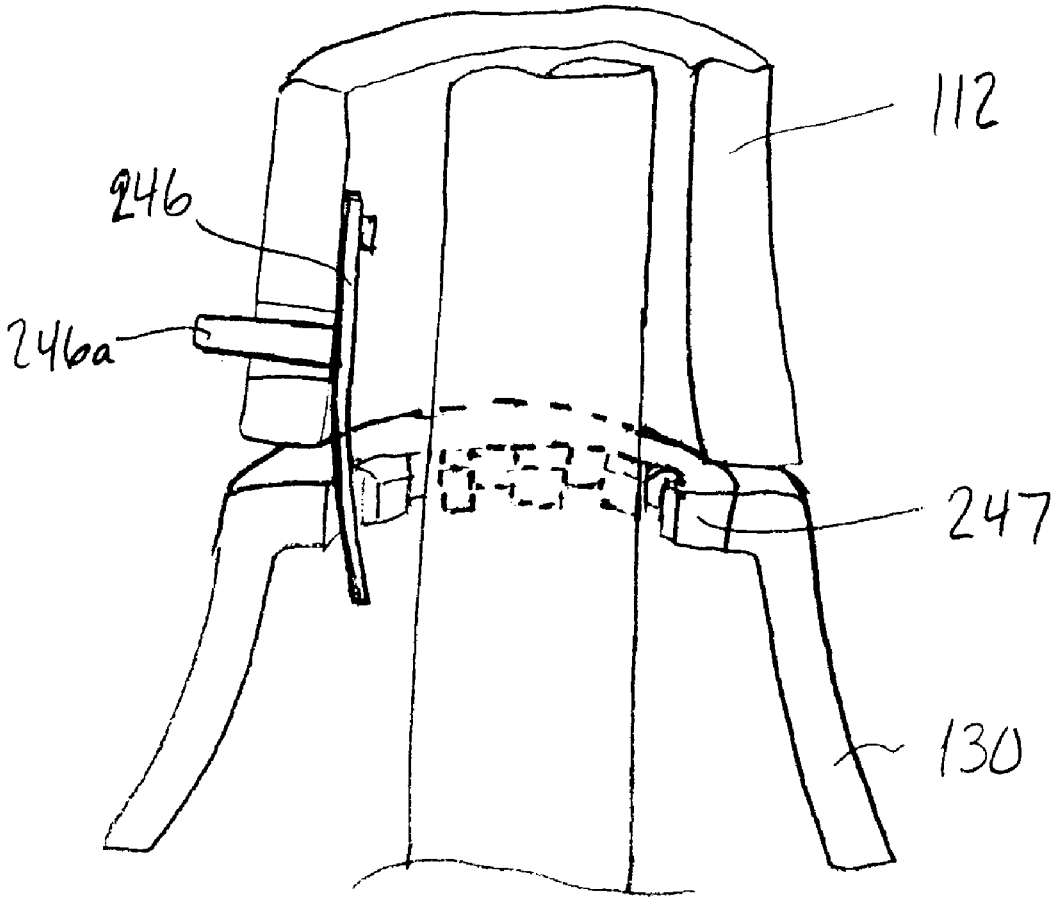
FIG. 9 is a partial sectional view of a detail of a handle of still a further embodiment of the present invention.

In another modification shown in FIG. 9, ring 130 includes a toothing 247 distributed along its interior peripheral circumference. Instead of a pushbutton 146 engaging a bore defined in the handle as in embodiment depicted in FIGS. 6–8, a pushbutton 246 is engagable with the ring toothing 247 to prevent unintended rotation of the handle relative to the ring. In this modification, the cover 114 is retainable in its fully closed position, its fully open position, or in any position therebetween when the pushbutton engages the toothing.

To effect the closing procedure, a user grasps the handle 112 and twists it relative to ring 130 so that shaft 142 telescopes into handle and the cover 114 is displaced toward its closed position. Depending on the strength of the user, the flexibility of the user and the position of the user's initial grip on the handle, it may be necessary to momentarily release the user's grip on the handle and realign the grip position to effect further twisting of the handle to attain the fully closed position. The modification of FIG. 9 facilitates this process by allowing the user to temporarily let go of the handle during the closing procedure to realign the user's grip position since interengagement of the pushbutton 246 and toothing 247 prevents return movement of the cover from an intermediate toward the open position should the user let go of the handle before the fully closed position is attained. The toothing 247 and pushbutton 246 may alternatively be implemented as a ratcheting pawl and toothing permitting unrestricted movement of shaft 142 into the handle but requiring actuation of pushbutton 246 to advance the shaft outwardly from the handle. This FIG. 9 modification thus allows the user to readily close the cover 114 without actuating pushbutton 246.

Figure 10:
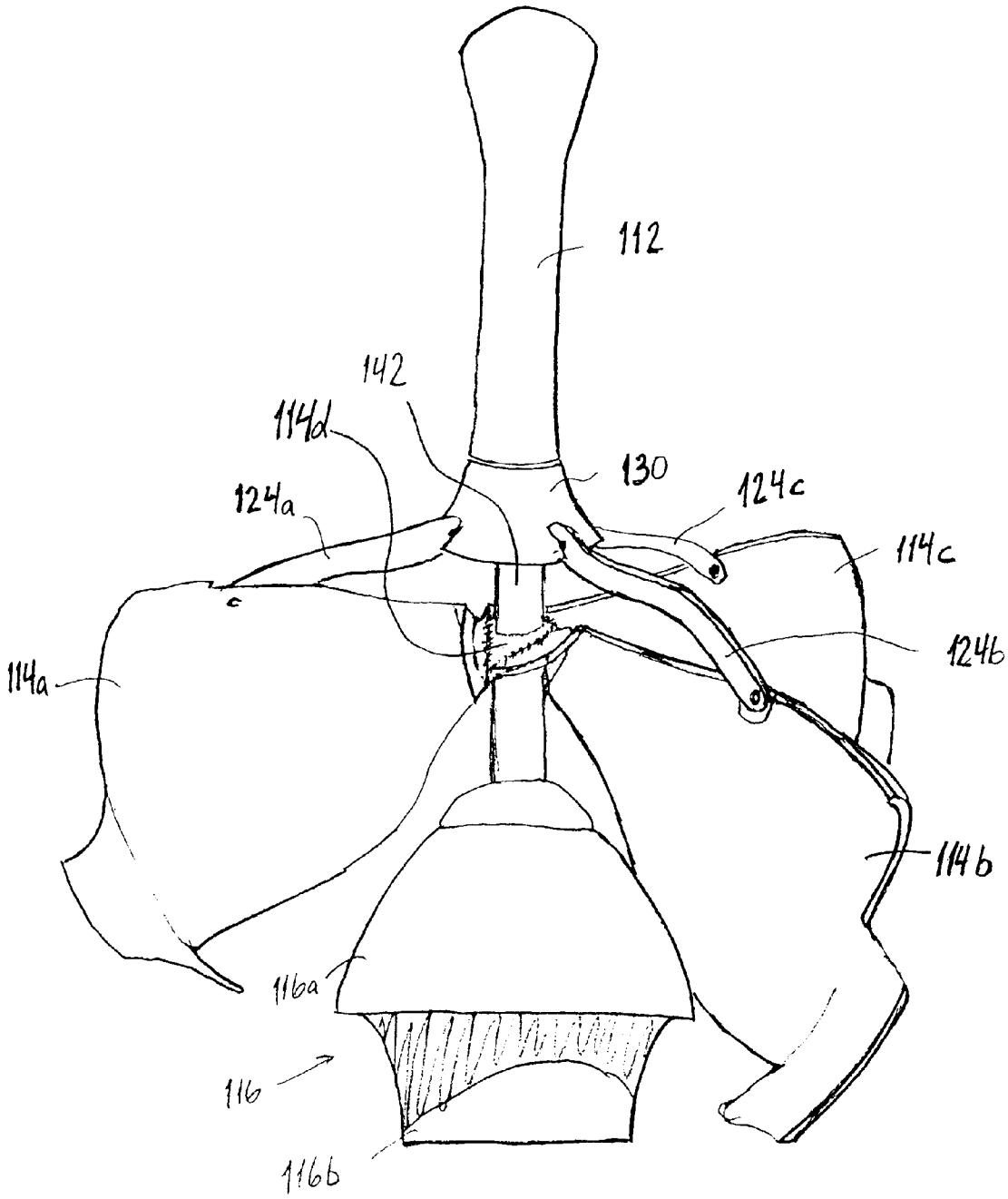
FIG. 10 is a side view of a further modification of the plunger of FIG. 7.

In still another modification of the plunger of FIGS. 6–8 the cover sections 114*a*, 114*b* and 114*c* may be pivotably or hingably connected to a central cover section fixedly mounted on the shaft 142. In this manner the entire cover 114 may be constructed as an integrated unit prior to mounting to the remainder of the plunger. As seen in FIG. 10, a center cover section 114*d* is fixedly mounted on shaft 142. Cover sections 114*a*, 114*b*, and 114*c* are hinged to center cover section 114*d* so that they are pivotable from a closed to an open position and may be configured in any suitable manner to minimize drippage from the plunger in the closed position of the cover. As should be apparent, the cover sections 114*a*, 114*b*, 114*c* an instead be pivotably connected to the center cover section 114*d* using a pivot pin as shown in FIG. 7.

As in the embodiment of FIGS. 1–5, the cover 114 in the various embodiments of FIGS. 6–10 may optionally be shaped to define an overlaying lip 18 that lies below head 116 and which forms a groove or trough 19 to retain any liquid that drips from the head during transport of the plunger from the site of use to the location of storage.

The cover 114 of FIGS. 6–10 need not be flexible and accordingly may be constructed of a hard plastic such as polypropylene or styrene or other rigid material. Handle 112 and links 124*a*, 124*b*, 124*c* may likewise be formed of a hard plastic or the like. The pivotal connections may be effected using, for example, metal or plastic pins. Furthermore, the projection 113 of handle 112 may be manufactured of a metal, hard plastic, or other suitably strong material. Shaft 142 may comprise a central portion 142*a* and an outer portion 142*b*, as shown in FIG. 8. The central portion 142*a* may be implemented in the manner of a conventional plunger shaft, as of wood or plastic, and the outer portion 142*b* may be formed of a hard plastic or other suitably strong material. The dripless functionality of the present invention may accordingly be readily added to or incorporated in an otherwise conventional plunger.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A plunger for user-manipulated operation to force water through a clogged drain and for minimizing dripping of water from the plunger, after operative use, onto an underlying floor surface as the plunger is transported from the drain to a plunger storage location remote from the drain, said plunger comprising:

a deformable head configured for opening-sealing placement over a clogged drain opening;

a user-graspable elongated shaft connected to said head for user-manipulated longitudinal displacement of said shaft to effect deformation of said head in opening-sealing placement over the clogged drain opening and thereby force water through the clogged drain; and a drip-minimizing cover on said shaft and disposed for user-effected movement between a first position in which said cover is positioned remote from said head when said head is disposed in opening-sealing placement over the clogged drain opening for user-manipulated use of the plunger to unclog the drain without interference from said cover, and a second position in which said cover at least partially envelopes said head to capture within said cover liquid that drips from said head when said head has been removed from said opening-sealing placement over the clogged drain opening for transport of the plunger from the drain to the remote storage location, said cover being configured for retaining within said cover the captured liquid that has dripped from said head into said cover and thereby preventing the captured liquid from dripping from the plunger onto the underlying floor surface.

2. The plunger of claim 1, wherein said cover defines a base having a bottom surface for supporting said plunger device in a freestanding upright position in said second position of said cover.

3. The plunger of claim 2, wherein said cover comprises a lip proximate said bottom surface and configured for retaining captured liquid that has dripped from said head into said cover in said second position.

4. The plunger of claim 3, wherein said lip defines a groove for collecting captured liquid that has dripped.

5. The plunger of claim 1, wherein said cover comprises a lip configured for retaining captured liquid that has dripped from said head into said cover in said second position.

6. The plunger of claim 5, wherein said lip defines a groove for collecting captured liquid that has dripped from said head.

7. The plunger of claim 1, wherein said cover comprises a plurality of sections divided by slits and outwardly deformably flexible for contact-caused outward deformation of said sections as said sections move envelopingly over said head as said cover is moved from said first position to said second position.

8. The plunger of claim 7, further comprising a cover-operating handle connected to said cover and said shaft and longitudinally displaceable along said shaft to move said cover between said first and second positions of said cover.

9. The plunger of claim 8, wherein said cover-operating handle comprises a hollow tube concentrically carried on said shaft and graspable by a user for user-manipulated displacement of said handle along said shaft.

10. The plunger device of claim 1, further comprising a cover-operating handle connected to said cover and said shaft and longitudinally displaceable along said shaft to move said cover between said first and second positions of said cover.

11. The plunger of claim 1, further comprising a cover-operating handle displaceably carried on said shaft for moving said cover between said first and second positions; and said cover comprising a plurality of discrete cover sections each mounted for pivotal movement relative to said shaft as said cover is moved between said first and second positions.

12. The plunger of claim 11, wherein each said cover section is operatively connected to said handle such that said each cover section pivots between a closed position proximate said head in said second position of said cover and an open position remote from said head in said first position of said cover, in response to a movement of said handle away from said head.

13. The plunger of claim 12, further comprising a ring clement connected to said handle and a plurality of links, each link of said plural links being connected between said ring and a corresponding one of said plural cover sections.

14. The plunger of claim 13, further comprising a spring disposed between said handle and said shaft to normally urge said handle along said shaft in a direction away from said head, and a retainer for maintaining said handle in a predetermined position of displacement along said shaft against the urgency of said spring.

15. The plunger of claim wherein said retainer comprises a pawl on said handle and a toothing on said ring for engagement with said pawl.

16. The plunger of claim 11, further comprising a central cover portion fixedly connected to said shaft, and each said cover section being operatively connected to said handle for pivotal movement relative to said handle as said handle is displaced to move said cover between said first and second positions.

17. The plunger of claim 16, further comprising a ring element connected to said handle and a plurality of links, each connected between said ring and a corresponding one of said plural of cover sections.

18. The plunger of claim 11, further comprising a spring disposed between said handle and said shaft to normally urge said handle along said shaft in a direction away from said head.

19. The plunger of claim 18, further comprising a retainer for maintaining said handle in a predetermined position of displacement along said shaft against the urgency of said spring.

20. The plunger of claim 19, wherein said retainer comprises a displaceable pushbutton carried on said shaft and engageable with said handle to maintain the predetermined position of displacement.

21. The plunger of claim 20, wherein said pushbutton is engagable with said handle when said cover is in said second position.

22. The plunger of claim 11, wherein said shaft comprises a helical groove and said handle comprises a projection configured for engaging said groove so that said handle twists relative to said shaft as said handle is displaced along the shaft to move said cover between said first and second positions.

23. The plunger of claim 22, further comprising a stop positioned for contact engagement with said handle projection to prevent displacement of said handle along said shaft beyond a predetermined limit position.

24. The plunger of claim 23, wherein said stop contacts said handle projection in said first position of said cover.

25. The plunger of claim 22, wherein said shaft comprises a central portion and an outer portion in which said helical groove is defined.

* * * * *